US005597290A

United States Patent [19]

Vipond et al.

[11] Patent Number: 5,597,290

[45] Date of Patent: Jan. 28, 1997

[54] MULTI-COMPONENT FAN ASSEMBLY

[75] Inventors: Edward W. Vipond, Gardener; Robert W. Shaffer, II, East Templeton, both of Mass.

[73] Assignee: Tuthill Corporation, Millbury, Mass.

[21] Appl. No.: 640,709

[22] Filed: May 1, 1996

[51] Int. Cl.[6] ..... F04D 29/34

[52] U.S. Cl. ..... 416/204 R; 416/220 R

[58] Field of Search ..... 416/204 R, 212 R, 416/220 R

[56] References Cited

U.S. PATENT DOCUMENTS

| | | | |
|---|---|---|---|
| 3,002,266 | 10/1961 | Lynn et al. | 416/212 R |
| 3,960,991 | 6/1976 | Schmitt et al. | 416/212 R |
| 4,566,857 | 1/1986 | Brumen | 416/220 R |
| 5,112,193 | 5/1992 | Greer et al. | 416/220 R |
| 5,263,823 | 11/1993 | Cabaret et al. | 416/220 R |
| 5,330,323 | 7/1994 | Swanson | 416/204 R |
| 5,462,411 | 10/1995 | Bianchi | 416/204 R |

*Primary Examiner*—John T. Kwon

*Attorney, Agent, or Firm*—Samuels, Gauthier, Stevens & Reppert

[57] ABSTRACT

A fan assembly has a circular disc with a rotational axis and first and second sides. A cylindrical side wall extends around the periphery of the disc. The side wall has axially spaced first and second rims and is circumferentially subdivided into a plurality of wall segments, each wall segment has inner and outer surfaces, with the second rim of the wall protruding axially beyond the second side of the disc. Fan blades are carried on the outer surfaces of the side wall segments. Mounting members protrude from the first side of the disc at locations spaced circumferentially around the periphery thereof. Connecting members on the inner surfaces of the wall segments coact in separable interlocked engagement with the mounting members to fasten the wall segments to the disc. A first ring on the first side of the disc prevents the connecting members from separating from their interlocked engagement with the mounting members. A second ring on the second side of the disc interconnects the wall segments.

19 Claims, 6 Drawing Sheets

MULTI-COMPONENT FAN ASSEMBLY

BACKGROUND OF THE INVENTION

1. Field of the Invention

This invention relates to multi-component fan assemblies for use in blowers and the like.

2. Description of the Prior Art

In one known type of multi-component fan assembly, as disclosed for example in U.S. Pat. Nos. 2,654,529 (Smith); 3,077,811 (Moore); 3,224,078 (Mayne); and 5,269,655 (Chang), at least some of the fan components are joined together by means of some form of permanent material deformation. This complicates assembly and disassembly by requiring the use of special tools or presses. In most cases, disassembly entails permanent destruction of some components.

In another type of known multi-component fan assembly, as disclosed for example in U.S. Pat. Nos. 4,256,435 (Eckel) and 5,281,095 (Glynn), blade components are assembled onto and protrude radially from a circular hub. In Eckel, the hub includes mounting blocks riveted between two retaining discs, with the blades being screwed to the mounting blocks. The use of multiple retaining discs contributes unnecessarily and disadvantageously to the overall weight and cost of the assembly, and also complicates assembly procedures. In Glynn, the hub includes a single disc to which the blade segments are attached by means of a retaining ring which can either be of a unitary split design, or which can be made up of multiple segments.

The radial disposition of the blades in the central plane of the hub in both the Eckel and Glynn arrangements limits the extent, if any, to which the fan assembly can be telescoped over the drive motor to achieve overall axial compaction.

One objective of the present invention is the provision of a fan assembly made up of a minimum number of components which can be easily assembled without permanent material deformation, and without the need to employ special tools or presses.

A companion objective of the present invention is the provision of a multi-component fan assembly having a hub in the form of a single circular disc, with a segmented wall extending axially in cantilever fashion from the periphery of the disc. The disc and wall segments are molded non-metallic components, with the wall segments serving as supports for the fan blades. The wall segments are interlocked to the disc as well as to each other by snap-engaged metal retaining rings which can be removed to accommodate disassembly of the fan components.

These and other objects, features and advantages of the present invention will become more apparent as the description proceeds with reference to the accompanying drawings, wherein:

DETAILED DESCRIPTION OF THE PREFERRED EMBODIMENT

Figure 1:
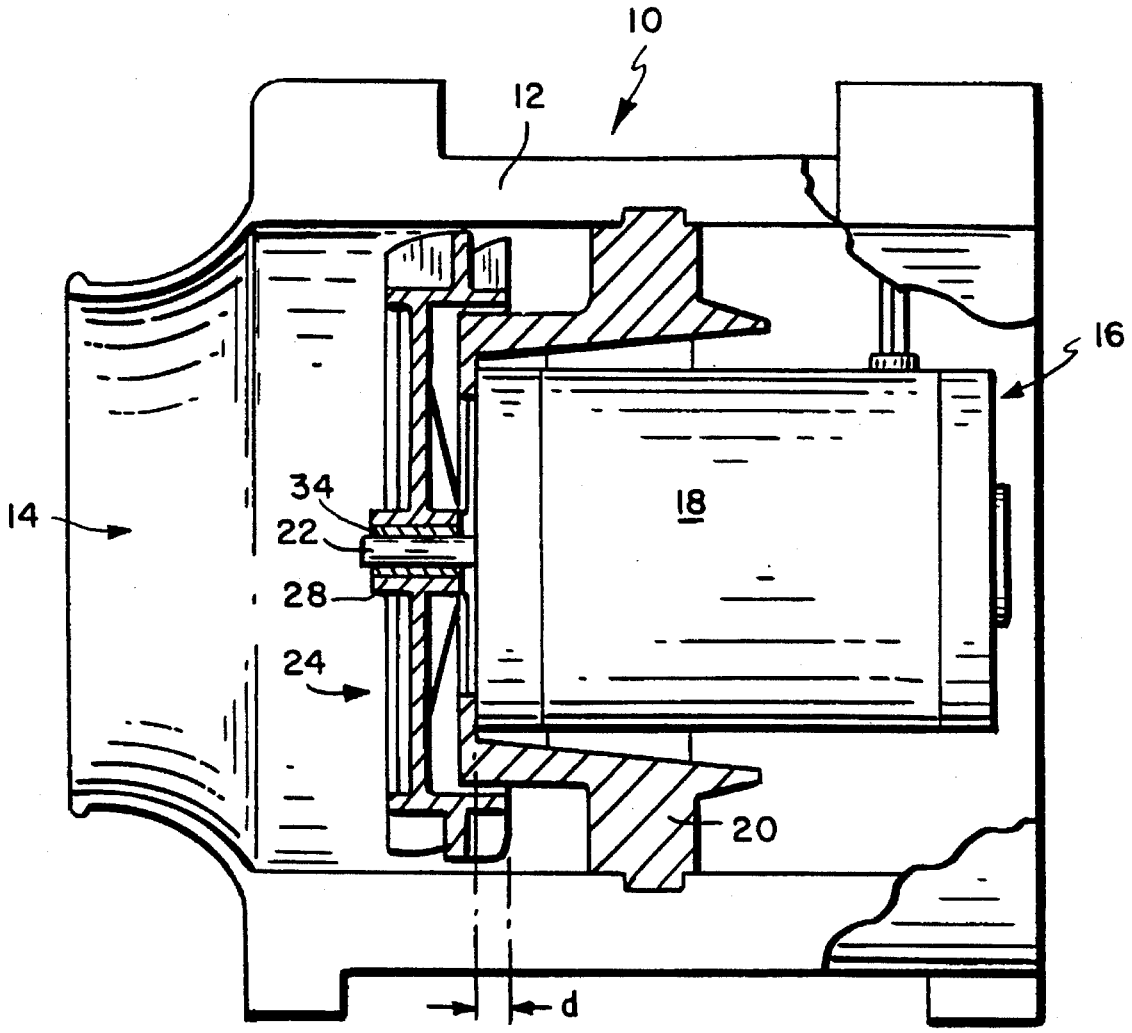
FIG. 1 is a schematic sectional view of a blower incorporating a multi-component fan assembly in accordance with the present invention.
Figure 2:
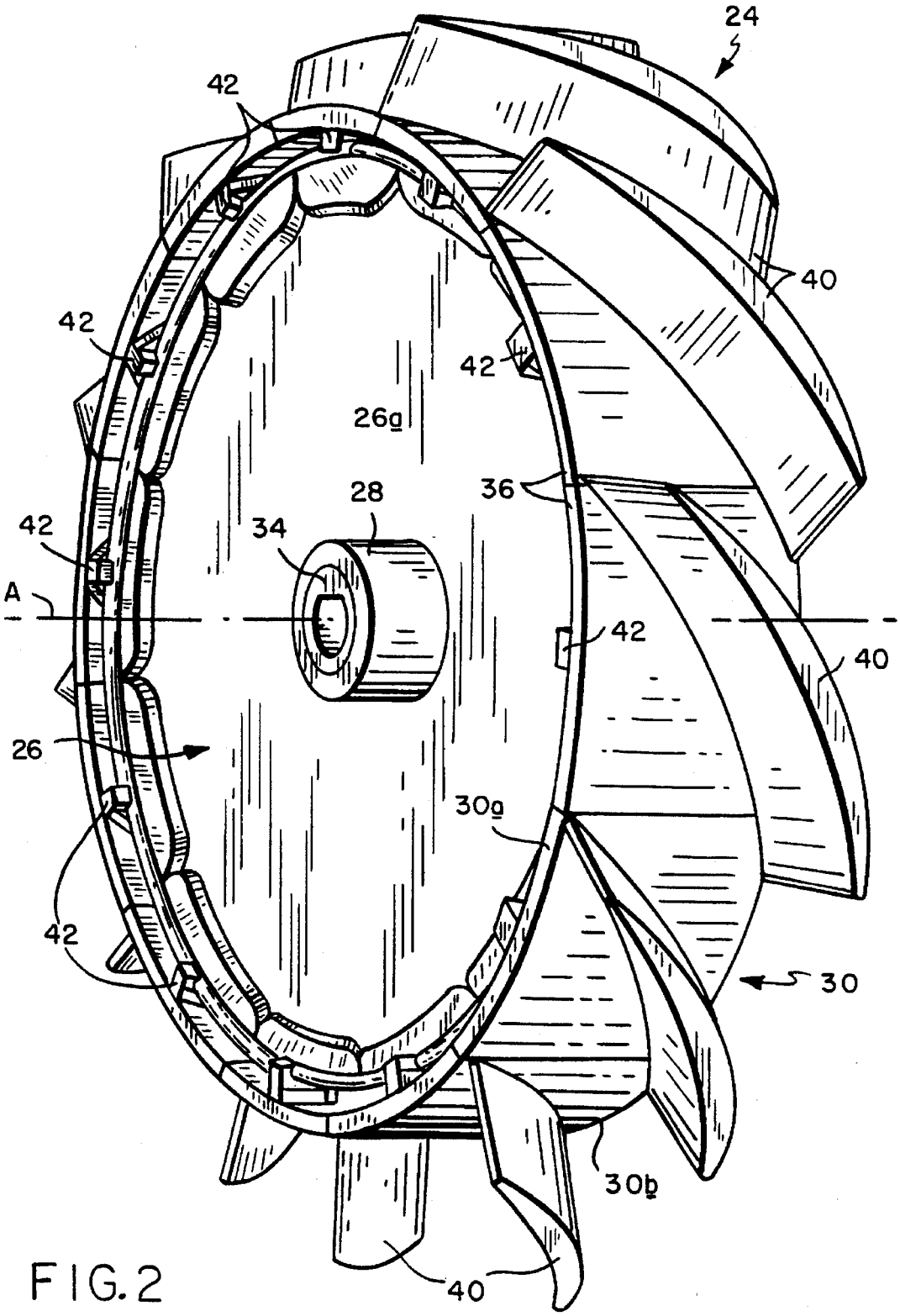
FIG. 2 is a front perspective view of the fan assembly shown in FIG. 1.
Figure 3:
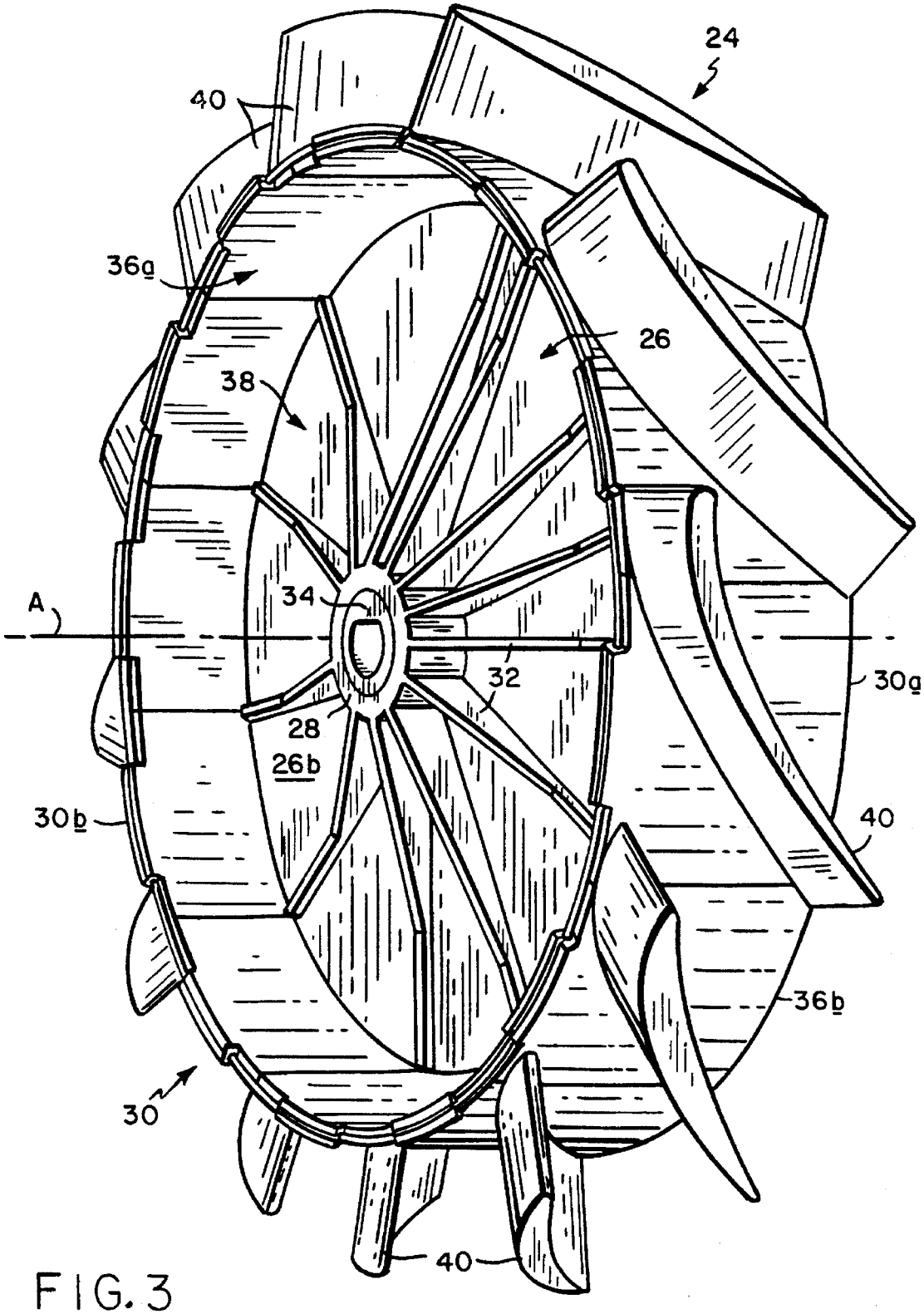
FIG. 3 is a rear perspective view of the fan assembly.
Figure 4:
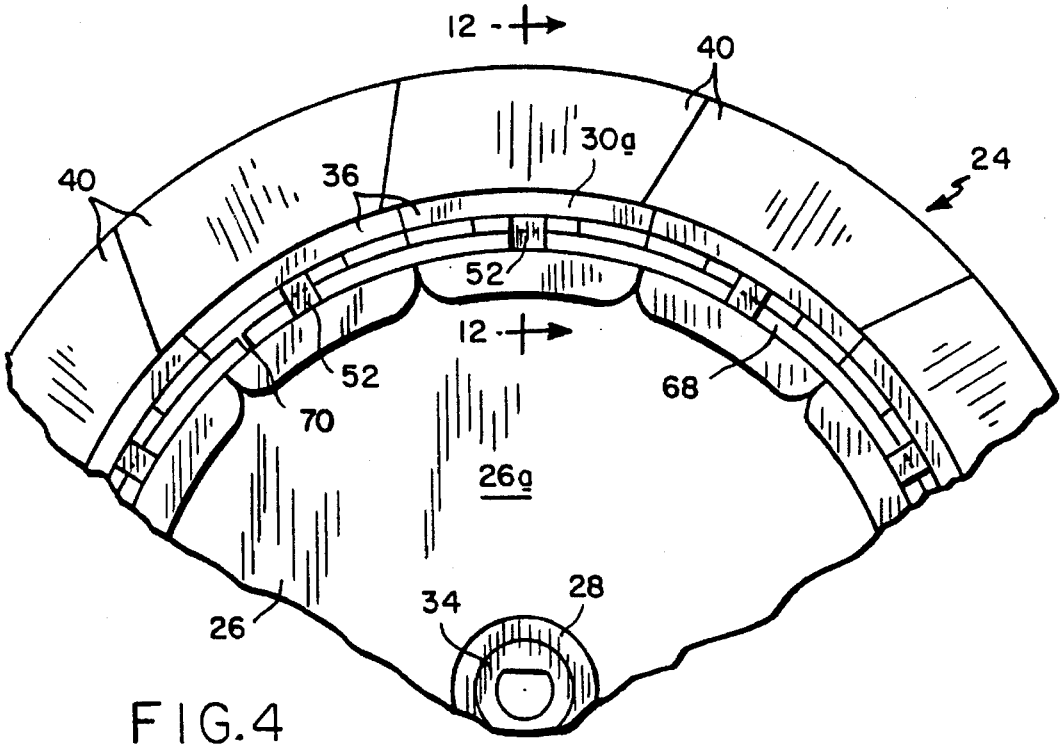
FIG. 4 is a partial front view of the fan assembly.
Figure 5:
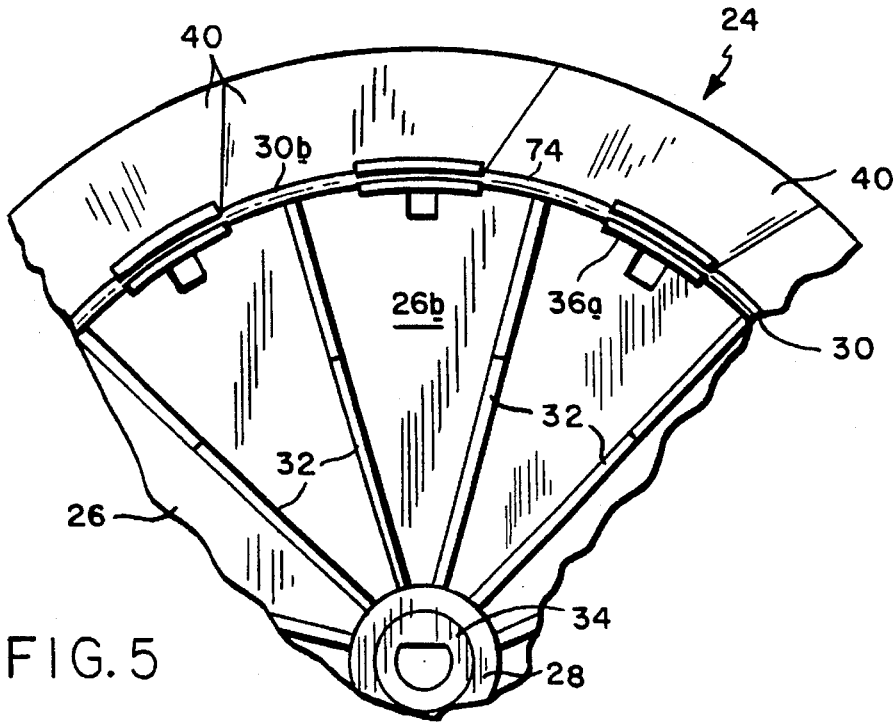
FIG. 5 is a partial rear view of the fan assembly.

Referring initially to FIG. 1, a blower 10 is shown having an external housing 12 with axially aligned inlet and outlet openings 14, 16. A motor 18 is supported within the housing by an internal motor mount 20. Motor 18 has an output shaft 22 carrying a multi-component fan assembly 24 in accordance with the present invention.

With reference additionally to FIGS. 2–7, it will be seen that fan assembly 24 includes a circular disc 26 having a rotational axis "A" defined by a central hub 28. The disc 26 has first and second sides **26*a*, 26*b* facing respectively forwardly toward the inlet opening 14 and rearwardly toward the outlet opening 16 of the blower 10. The central hub 28 protrudes axially in opposite directions from the first and second sides 26*a*, 26*b*** of the disc.

A cylindrical side wall 30 extends around the periphery of the disc 26. Circumferentially spaced reinforcing ribs 32 extend radially across the second disc side **26*b* from the central hub 28 towards the side wall 30. The disc 26, hub 28 and reinforcing ribs 32 are integrally molded of a non-metallic material such as for example glass-reinforced polyester resin. The central hub 28 is lined with a metallic bushing 34 configured and dimensioned to be keyed or otherwise secured to the output shaft 22 of the blower motor 10**.

The cylindrical side wall 30 has axially spaced first and second rims **30*a*, 30*b* and is circumferentially subdivided into a plurality of wall segments indicated typically at 36. Each wall segment has inner and outer surfaces 36*a*, 36*b*. The wall 30 extends rearwardly in cantilever fashion from the disc 26 and cooperates with the second disc side 26*b* to define a circular cavity 38. As can be best seen in FIG. 1, the cavity 38 allows the fan assembly 24 to be partially telescoped over the forward end of the drive motor 18 by a distance "d", thereby contributing beneficially to the overall axial compactness of the blower 10**.

Fan blades 40 are located on the outer surfaces **36*b* of the wall segments 36. The wall segments and their respective fan blades are preferably integrally molded of the same non-metallic material used to mold the disc 26**.

Figure 8:
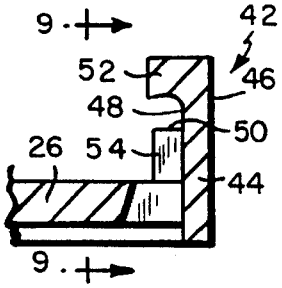
FIG. 8 is a vertical cross sectional view on an enlarged scale taken through a mounting member on the disc.
Figure 9:
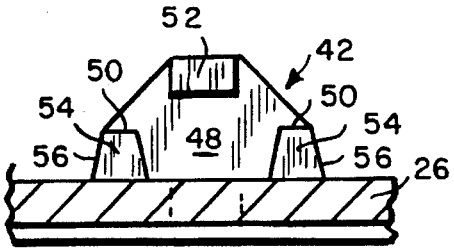
FIG. 9 is a sectional view taken along line 9—9 of FIG. 8.

Mounting members 42 protrude from the first side **26*a* of the disc 26 at locations spaced around its periphery. As can best be seen by further reference to FIGS. 8 and 9, each mounting member 42 includes a flange segment 44 having an outer curved surface 46 extended coextensively with the periphery of the disc, and an inner curved surface 48 facing towards the rotational disc axis A. The flange segments have a generally triangular configuration, with radially inwardly projecting feet 50 at opposite ends of the base, and with a radially inwardly projecting nose 52 at the apex. The feet 50 define locating surfaces 54 and 56**.

Figure 10:
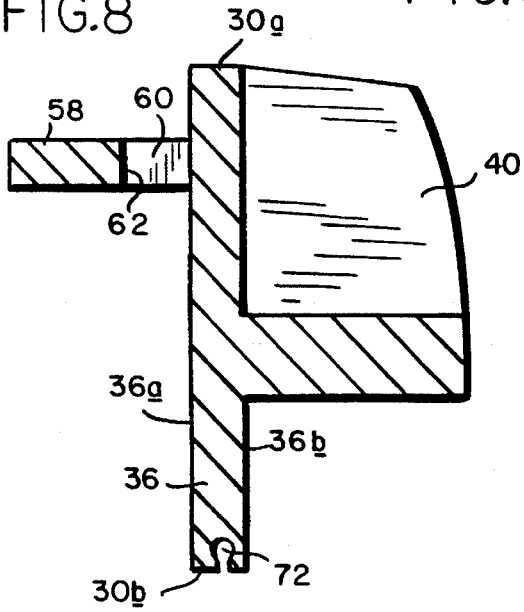
FIG. 10 is a vertical cross sectional view taken through one of the wall segments.
Figure 11:
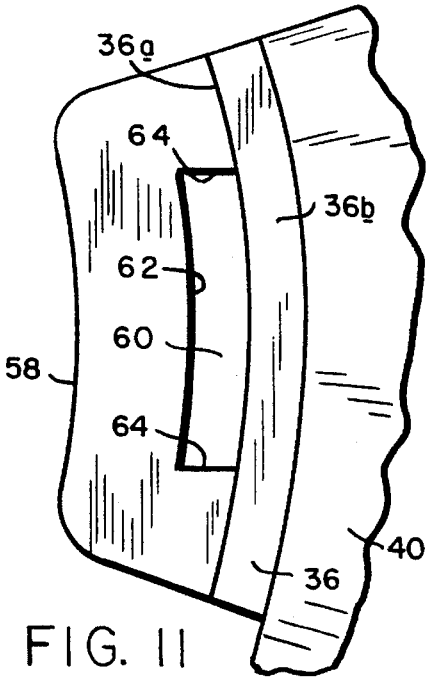
FIG. 11 is a top plan view of a wall segment.

With reference additionally to FIGS. 10 and 11, it will be seen that the wall segments 36 include integral connecting members in the form of ribs 58 protruding radially inwardly from inner surfaces 36*a*. The ribs 58 have arcuate openings 60 which are delimited radially by the inner surfaces 36*a* of the wall segments and parallel inner rib edges 62, and which are delimited circumferentially by end edges 64.

Figure 6:
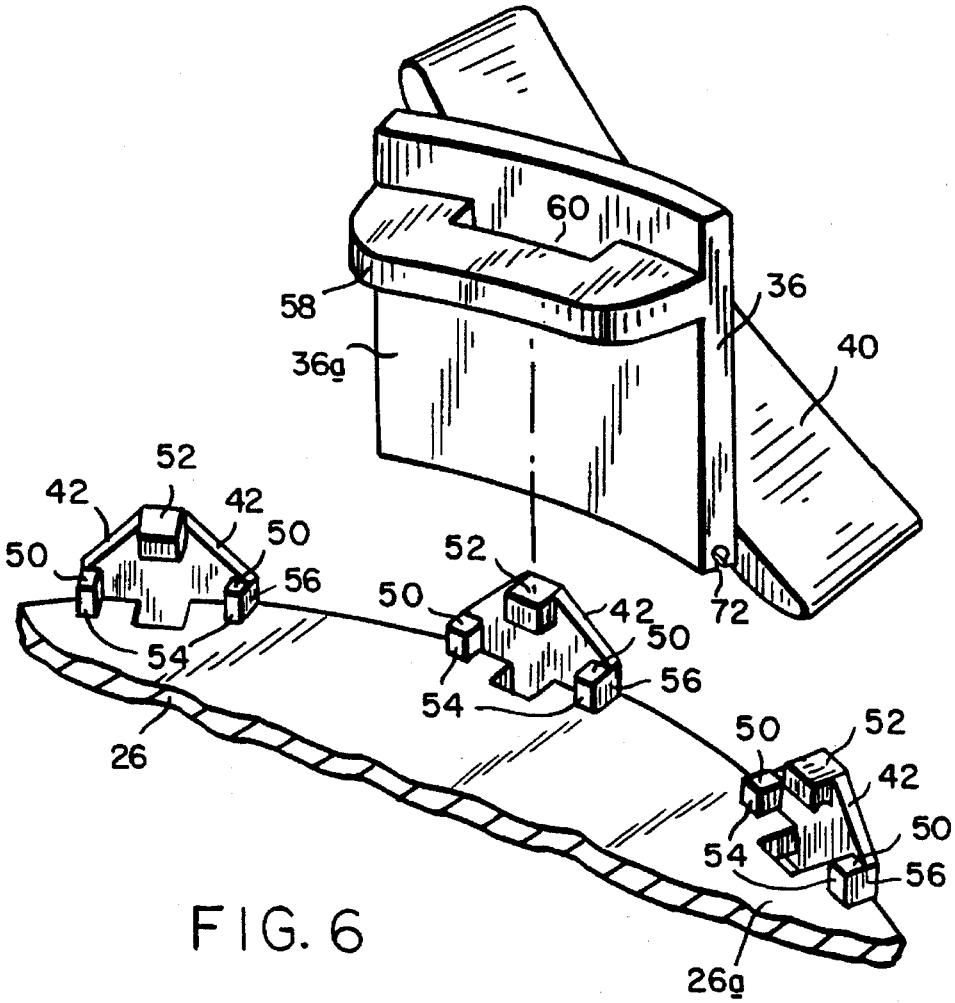
FIG. 6 is an exploded perspective view showing a wall segment and associated blade prior to its assembly onto the central disc.
Figure 7:
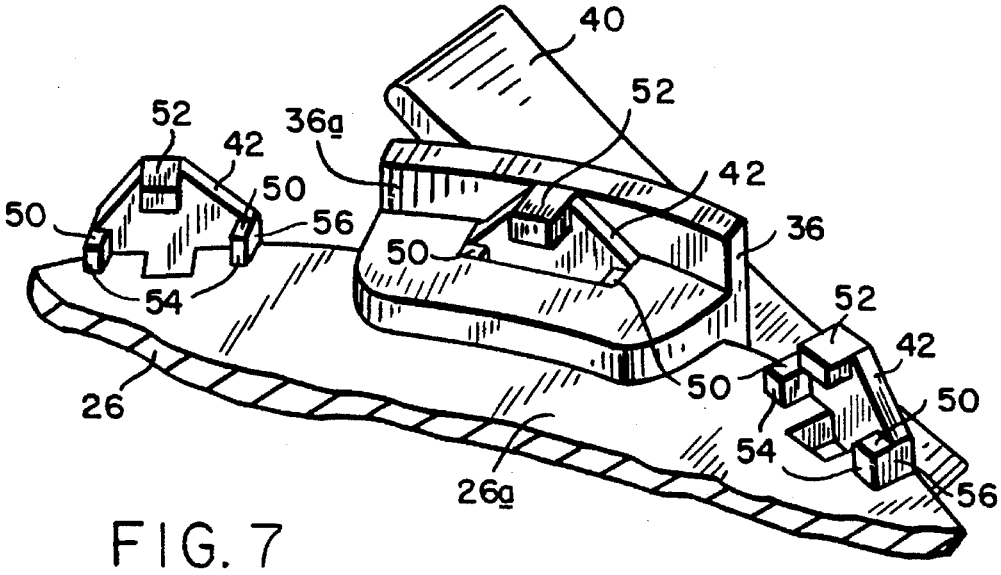
FIG. 7 is a view similar to FIG. 6 showing the wall segment assembled onto the disc.

During assembly, the wall segments 36 are initially oriented with respect to the disc 26 as depicted in FIG. 6, and are then mounted on the disc as shown in FIG. 7. When thus mounted, the mounting members 42 protrude through the arcuate openings 60, allowing the ribs 58 to overlap and be seated against the first surface 26*a* of the disc 26. The wall segments 36 are fixed radially with respect to the disc as a result of: (a) the face-to-face contact between the outer curved surfaces 46 of the flange segments 44 and the inner surfaces 36*a* of the wall segments; and (b) engagement of the locating surfaces 54 on the feet 50 with the inner rib edges 62. The wall segments are also fixed circumferentially with respect to the disc as a result of engagement of the locating surfaces 56 on the feet 54 with the end edges 64 of the openings 60.

Figure 12:
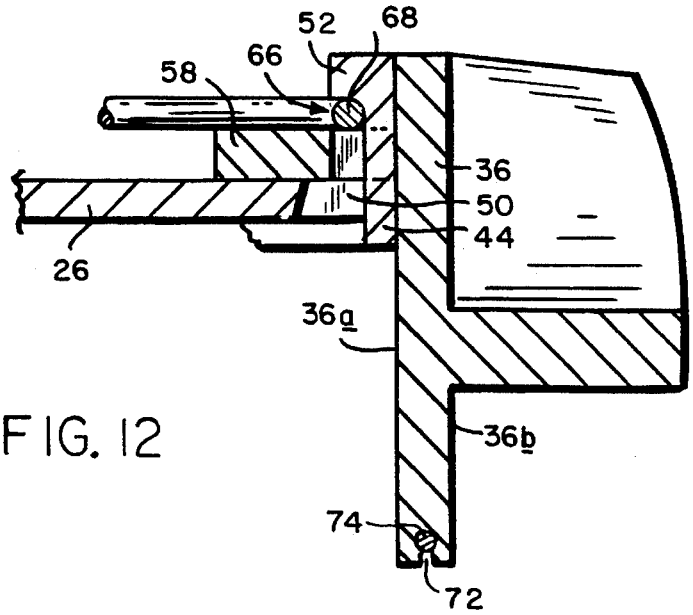
FIG. 12 is a sectional view on an enlarged scale taken along line 12—12 of FIG. 4.

When the wall segments 36 are mounted on the disc 26, as can best be seen in FIG. 12, the noses 52 on the flange segments 44 are spaced from the ribs 58 to define retention grooves 66. A first metallic ring 68 is snapped into the grooves 66 to serve as a means for preventing the ribs 58 from separating from their interlocked engagement with the mounting members 42. The ring 68 is preferably split as at 70 (see FIG. 4) to accommodate its snapped engagement into the grooves 66.

The wall segments 36 are peripherally grooved as at 72 along the second rim 30*b* to receive a second metallic ring 74. The ring 74 is continuous and serves to circumferentially interconnect the wall segments 36 at their cantilevered ends, thereby providing a means for resisting centrifugal forces generated during fan rotation.

In light of the foregoing, it will now be appreciated by those skilled in the art that the fan assembly of the present invention is made up principally of molded non-metallic components, those being the support disc 26 and the wall segments 36. Mounting of the wall segments is accomplished by simply engaging the integral mounting members 42 of the support disc within the openings 60 of the ribs 58 on the wall segments, followed by snap engagement of the metallic rings 68, 74.

No special tooling is required to effect assembly of these components. Moreover, no permanent material deformation is involved in the assembly procedure.

By cantilevering the wall segments 36 from the rear edge of the central supporting disc, a circular cavity 38 is defined for receiving the forward end of the drive motor 18, thereby accommodating a beneficial telescoping of these components with a resulting decrease in the overall axial length of the blower 10.

We claim:

1. A fan assembly comprising in combination:

a circular disc having a rotational axis and first and second sides;

a cylindrical side wall extending around the periphery of said disc, said side wall having axially spaced first and second rims and being circumferentially subdivided into a plurality of wall segments, each wall segment having inner and outer surfaces, with the second rim of said wall protruding axially beyond the second side of said disc;

fan blades carried on the outer surfaces of said side wall segments;

mounting members protruding from the first side of said disc at locations spaced circumferentially around the periphery thereof;

connecting members on the inner surfaces of said wall segments, said connecting members coacting in separable interlocked engagement with said mounting members to fasten said wall segments to said disc;

first ring means on the first side of said disc for preventing said connecting members from separating from their interlocked engagement with said mounting members; and second ring means on the second side of said disc for interconnecting said wall segments.

2. The fan assembly of claim 1 further comprising a central cylindrical hub protruding axially in opposite directions from the first and second sides of said disc.

3. The fan assembly as claimed in claim 2 further comprising circumferentially spaced reinforcing ribs on at least one side of said disc extending radially from said central hub towards said cylindrical side wall.

4. The fan assembly as claimed in claim 3 wherein said reinforcing ribs are located on the first side of said disc.

5. The fan assembly as claimed in either claim 3 or 4 wherein said disc, central hub and reinforcing ribs are integrally molded of a non-metallic material.

6. The fan assembly of claim 5 further comprising a metallic bushing lining said cylindrical hub.

7. The fan assembly as claimed in claim 5 wherein said side wall segments and their respective fan blades and connecting members are integrally molded of a non-metallic material.

8. The fan assembly as claimed in claim 7 wherein said first and second ring means comprise metallic rings.

9. The fan assembly as claimed in claim 8 wherein said first ring means is continuous and said second ring means is split.

10. The fan assembly as claimed in claim 1 wherein said mounting members include flange segments having outer curved surfaces extending coextensively with the periphery of said disc, said outer curved surface being in face-to-face contact with the inner surfaces of said wall segments.

11. The fan assembly of claim 10 wherein said connecting members comprise ribs protruding inwardly from the inner surfaces of said wall segments, the flange segments of said mounting members protruding through arcuate openings in said ribs with said ribs being arranged to overlap the second surface of said disc.

12. The fan assembly of claim 11 wherein the openings in said ribs are delimited radially by the inner surfaces of said wall segments and parallel inner edges, and wherein said inner edges coact with locating surfaces on said mounting members to maintain the curved outer surfaces of said flange segments in face-to-face contact with the inner surfaces of said wall segments.

13. The fan assembly of claim 11 wherein the openings in said ribs are delimited circumferentially by end edges, and wherein said end edges coact with locating surfaces on said mounting members to circumferentially fix said wall segments with respect to said disc.

14. The fan assembly as claimed in either claim 12 or 13 wherein said locating surfaces are defined by feet projecting radially inwardly from said flange segments.

15. The fan assembly as claimed in claim 11 further comprising nose members projecting radially inwardly from said flange segments, said nose members being spaced from said ribs to define retention grooves configured and arranged to receive said first ring means.

16. The fan assembly as claimed in claim 15 wherein said first ring means comprises a split ring.

17. The fan assembly as claimed in claim 16 wherein said split ring is snap engaged into said retention grooves.

18. The fan assembly as claimed in claim 1 wherein said wall segments are provided with retention grooves, and wherein said second ring means is snapped into engagement within said retention grooves.

19. The fan assembly as claimed in claim 18 wherein said retention grooves are located along the second rim of said side wall.

* * * * *